US006626464B1

(12) United States Patent
Flaherty et al.

(10) Patent No.: US 6,626,464 B1
(45) Date of Patent: Sep. 30, 2003

(54) FORM WITH LABEL AND NON-LABEL PORTIONS, AND METHOD OF MANUFACTURING SAME

(75) Inventors: Patrick A. Flaherty, Joplin, MO (US); Leonard G. Gamble, Valrico, FL (US)

(73) Assignee: Convergent Label Technology, Tampa, FL (US)

( * ) Notice: Subject to any disclaimer, the term of this patent is extended or adjusted under 35 U.S.C. 154(b) by 114 days.

(21) Appl. No.: 09/832,291

(22) Filed: Apr. 10, 2001

Related U.S. Application Data

(63) Continuation-in-part of application No. 09/804,113, filed on Mar. 12, 2001.

(51) Int. Cl.[7] ..... B42D 15/00

(52) U.S. Cl. ..... 283/81; 283/101; 283/105; 283/900; 40/638; 428/40.1

(58) Field of Search ..... 283/79, 80, 81, 283/101, 105, 900; 428/40.1; 40/299, 638

(56) References Cited

U.S. PATENT DOCUMENTS

| | | | | |
|---|---|---|---|---|
| 3,752,723 A | | 8/1973 | Bruneau | |
| 4,022,926 A | | 5/1977 | Keough et al. | |
| 4,277,089 A | | 7/1981 | Lockhart | |
| 4,799,712 A | | 1/1989 | Biava et al. | |
| 4,886,680 A | | 12/1989 | Tindall | |
| 5,037,668 A | * | 8/1991 | Nagy | 427/44 |
| 5,154,956 A | * | 10/1992 | Fradrich | 428/40.1 |
| 5,328,208 A | | 7/1994 | Garrison | |
| 5,571,358 A | | 11/1996 | Napier et al. | |
| 5,642,906 A | | 7/1997 | Foote et al. | |
| 5,658,661 A | * | 8/1997 | Mitchell, Jr. et al. | 428/352 |
| 5,766,401 A | | 6/1998 | Campbell et al. | |
| 5,792,296 A | | 8/1998 | Soltysiak | |
| 5,855,395 A | | 1/1999 | Foote et al. | |
| 6,036,231 A | | 3/2000 | Foote et al. | |
| 6,071,585 A | | 6/2000 | Roth | |
| 6,110,554 A | | 8/2000 | Moeller et al. | |
| 6,153,045 A | | 11/2000 | Soltysiak et al. | |
| 6,299,945 B1 | * | 10/2001 | Mertz et al. | 427/503 |

* cited by examiner

*Primary Examiner*—Willmon Fridie, Jr.
(74) *Attorney, Agent, or Firm*—Baker & Hostetler, L.L.P.

(57) ABSTRACT

The present invention relates to a form with label and non-label portions that is useful for, inter alia, pharmacy applications. The form generally comprises a liner coated with a release agent that has been cured to a stable state using ultraviolet radiation(UV), and further coated with a pressure sensitive adhesive cured to a stable state using UV. The adhesive coated-face of the liner is mated to a bond paper face sheet. Optionally, the liner may be preprinted prior to coating with a release agent. The form is manufacturable in a single production line.

32 Claims, 5 Drawing Sheets

FORM WITH LABEL AND NON-LABEL PORTIONS, AND METHOD OF MANUFACTURING SAME

CROSS-REFERENCE TO RELATED APPLICATIONS

This application is a continuation-in-part of application Ser. No. 09/804,113, having a filing date of Mar. 12, 2001.

BACKGROUND OF THE INVENTION

It is often desirable to have a form with both label and non-label portions that can be custom-printed with certain data. Pharmacies, which provide ever-increasing amounts of information to patients receiving prescription drugs, are one such application. For example, most pharmacies now provide patients with a leaflet or other handout containing information about a prescribed medication. Similarly, an increasingly large amount of information is now provided on a prescription drug container. Notably, it is often necessary or desirable to include certain warnings on dispensed pharmaceuticals or medical devices. These warnings can include (but not be limited to) a warning that a drug may cause drowsiness; instructions to take a medication with food; warnings against a drug's interaction with other medications; and numerous other types of messages with regard to a prescribed medication. Typically, a pharmacist selects one or more separate warning labels from a variety of pre-designed warning labels. The selected warning labels are applied to the prescription container in addition to a standard label giving the name of the medication, dosage, prescriber's name, patient name, etc. Pharmacies also need to generate numerous other documents each time a prescription drug is dispensed. These can include receipt(s) for the patient or other parties, documents to be forwarded to an insurance company, separate labels for affixation to an inventory of dispensed medications, separate labels for affixation to a signature log for the patient to acknowledge receipt of the medication and/or advisory information, and innumerable other documents.

The advent of smaller, faster and less expensive desktop laser printers, which are able to print customized pharmacy labels and related documents, together with advances in computer technology and attendant cost decreases, have allowed pharmacies to print customized labels and other patient-specific documents on blank, standardized forms. Often, these forms have multiple components which can be separated to create a vial label, one or more warning labels, a patient advisory handout, a receipt, and other documents. Examples of such forms include those disclosed by U.S. Pat. No. 5,328,208 and 5,642,906, both of which are incorporated herein by reference. One or more areas of the reverse face of such forms are typically coated with a pressure-sensitive adhesive, which is in turn removably adhered to a liner coated with silicone or other release agent. These forms can be custom printed by the pharmacist, through the use of an on-site printer, to generate vial labels, a patient receipt, patient warning labels, other labels that can be used for various purposes (e.g., patient signature on a log of prescriptions dispensed, inventory information, etc.), patient handouts (e.g., a pamphlet containing information about the prescribed medication), and other documents. After printing, the pharmacist can then separate these various components from the starting form and, as appropriate, affix them to a drug container, provide them to the patient as a handout, or otherwise use them to document dispensing of a drug or medical device.

These and other known forms suffer several drawbacks. A pharmacy may often desire to print patient-specific information on both front and reverse faces of a blank form, also known as duplex printing. For example, a particular medication may require more advisory information than can be contained upon one face of a standard-sized (8½"×11" or 8½"×14") form. In addition to the ever-increasing amount of information a pharmacy wishes to provide to a patient regarding a pharmaceutical, the pharmacy may also wish to provide advertising or other information. Current pharmacy form designs can contaminate a pharmacy's printer with adhesive over time, and duplex printing can aggravate this problem. As each form containing an adhesive label is passed through a laser printer, small amounts of adhesive can be extruded from between the label portions and the liner as the form passes through the laser printer's fuser roller, and is pinched by the printer's fuser and back-up rollers. Over time, these small amounts of extruded adhesive accumulate and prevent proper functioning of the printer. If the adhesive contamination is extensive enough, it can severely damage the printer. There are known methods to tie portions of the labels together that will help reduce the ability of the adhesive to migrate out of the form. For example, one form design ties together adjacent label portions, with small pieces of label material that span the die cuts separating labels, to prevent them from inadvertently unpeeling in the printer. However, such forms tend to be more inconvenient and time-consuming for the pharmacist or other person trying to remove the labels from the form, and do not completely solve the problem of adhesive contamination. A moderately-sized pharmacy may print 300 to 500 pharmacy labels and forms per day, resulting in a frequent need to clean, repair or replace printers. If a form is duplex printed (i.e., printed on both sides by a pharmacy), it will usually be necessary for that form to pass through a printer twice. In addition to doubling the opportunities for adhesive to be extruded from that form (as the form will have to be heated and pinched twice by the printer's rollers), the extra time in the printer can heat conventional hot-melt and emulsion acrylic adhesives typically used in existing forms. That adhesive thus becomes more fluid and more easily extruded from the form as it passes through a printer.

The paper used in the construction of many existing pharmacy forms is also a potential source of problems during duplex printing. Often, a form is designed with the least expensive paper possible to reduce costs. The first pass through a laser printer's fuser section, which typically is heated from 385° F. to 414° F., draws significant internal moisture from the paper, causing curl. During the first pass, the label end of the form is typically the lead edge. During the second pass, the non-label portion is typically the lead edge. The excessive curl in the bond paper portion, induced during the first pass, can pose great problems when the printer tries to feed this curl through its paper path. A jam within the printer will likely occur which will require reprinting of the form at the least and possibly a service call if the jam is severe enough.

Commercially- and readily-available laser printers normally print on standardized paper lengths. In the United States, the most common sizes are 8.5 inches by 11 inches and 8.5 inches by 14 inches. There are several ways that a form manufacturer can match an individual pharmacy's bond paper requirements to label material requirements and result in an 11 inch or a 14 inch form length. As one option, an 11 inch or 14 inch length of bond paper form stock is attached to label material, and excess bond paper removed to create a form with a standardized length. However, this method is wasteful and can greatly increase the cost of the form to the customer. Accordingly, the more common method for a manufacturer to produce standard-sized forms with label and non-label portions is to order a specific width of bond paper that, when attached to a specific width of label material, creates an 11" or 14" form. This maximizes the use of the bond paper and label material and decreases waste and cost. Unfortunately, the need to inventory many specific widths of label material, and corresponding widths of bond paper needed to produce a standard sized form, can greatly increase inventory costs for form manufacturers and order lead times for the manufacturer's customers. Indeed, current form manufacturing methods often require manufacturers to inventory multiple widths of pressure sensitive label material and bond paper for each customer's particular label requirements. Each pharmacy chain or operation has specific internal requirements for the sizes and types of labels and non-label documents needed for each prescription. The ratio of the adhesive label and non-label portions of a pharmacy form can therefore vary widely among a form manufacturer's various pharmacy customers. As but one example, one pharmacy may desire that the form it uses have additional areas backed with adhesive so as to allow that pharmacy to print receipts and paste them onto a customer's prescription bag, while another pharmacy may prefer to include the receipt inside the bag (and without adhesive).

Current manufacturing techniques generally involve mating a pre-formed pressure sensitive label stock (which has previously been coated with a silicone release agent and pressure-sensitive adhesive) to bond paper or other material. This can result in a seam on the finished form which is unusable to a pharmacy or other end user. Moreover, silicone and other coatings useful for purposes of a release liner are generally not suited for printing. If a finished form is to have printed matter on the face of the release liner coated with a release agent, that liner must be printed prior to treatment with silicone or other release agent. Using conventional methods, this often requires a form manufacturer to maintain an inventory of pre-printed release liner material.

For these and other reasons that will be discussed herein or are readily apparent to persons skilled in the art, there is a need for a form with label and non-label portions that can be printed on both sides, which will minimize printer contamination, and which will provide reliable transport of the forms through the printer during the duplex process.

SUMMARY OF THE INVENTION

The present invention overcomes several disadvantages of prior forms having both label and non-label portions. The invention further allows such forms to be manufactured in a single production line and allows a form manufacturer to avoid maintaining an inventory of multiple sizes of pre-prepared label stock. The invention further facilitates double-sided printing of a form in a laser printer while minimizing printer contamination with adhesive forced from the form during laser printing.

The form of the present invention comprises a bond paper face sheet affixed to a paper release liner, and can be formed in a single pass through a rotary flexographic printing press. A face of the liner is (optionally) printed, then coated with a release agent and an adhesive. Unlike prior forms, the liner printing, release agent and adhesive are applied during manufacture of the form and cured to a stable state using ultraviolet radiation. Printing, silicone release agent and adhesive are applied to the wire side of the liner paper, and the other face of the liner paper has a machine finish to ensure toner anchorage when variable data is printed by a laser printer.

The liner paper is roll-fed into a press using equipment well known in the art. If desired, the liner is first printed with an ultraviolet radiation (UV)-curable background ink by any of numerous methods well known in the art, such as rotary flexographic or rotary offset, and then cured with UV. If necessary the liner may pass through multiple stations of imprinting and curing of background ink. The liner is then coated with a UV-curable silicone release agent by any of various methods and equipment well known in the art, but application by flexographic plate is preferable and allows for pattern coating. Pattern coating allows for specific placement of the release agent within the form to allow certain areas of the form to be removable while allowing other areas to remain attached to the liner. After application, the silicone release agent is cured using UV. A UV-curable adhesive is then applied onto the surface of the liner having the cured silicone release agent by, preferably, rotary flexographic press using a flexographic plate allowing the adhesive to be pattern coated in specific areas so as to minimize the ability of the adhesive to migrate into the laser printer during printing of variable data. Use of UV-curable adhesive and pattern coating of the adhesive allows application in a much more precise and limited manner than would be possible using conventional methods and adhesives. Application of the adhesive using a flexographic plate, instead of by a flood roller or an extrusion head (as is most often used), allows for precise register of the adhesive within particular areas. Typical hot melt adhesives are applied using a slot extrusion coating method which does not allow offsetting of the adhesive along the sheeted edge of the form. The application of adhesive using a flexographic plate allows very precise adhesive application in very specific areas. By altering the properties of the adhesive plate, it is also possible to vary the coat weight of the adhesive in specific areas to control the adhesion properties of the label. This added precision allows, for example, the area of adhesive application to be offset from the sheeted and web edges of the completed form. This offset of the adhesive helps prevent printer contamination when the form is passed through a user's laser printer. Specifically, as the form passes through a printer's rollers, any adhesive that is squeezed by the rollers' pressure on the faces of the form does not extrude to the edge of the form, and thus does not escape to damage the printer's components. Moreover, improved qualities of UV-curable adhesives in comparison to conventional hot-melt and emulsion acrylic adhesives help prevent printer contamination, as UV-curable adhesives do not become as fluid as conventional hot-melt or emulsion acrylic adhesives when heated by a laser printer.

After application of the adhesive to the liner web, the adhesive is cured-with UV to a stable state. After adhesive curing, the adhesive-coated face of the liner is mated to a bond paper face sheet as part of the same production line. Preferably, the face sheet is 24# laser printable paper, as such papers have shown to be moisture stable under the heat and pressure of duplex printing through a laser printer, but are sufficiently pliable so as to allow convenient affixation of a label portion to a medicine vial. The mated liner and face sheet may then pass through one or more series of ink application and dryer stations. After printing is complete, the mated and printed liner and face sheet may be die cut, perforated, cut into individual forms, stacked, folded, etc.

DESCRIPTION OF THE PREFERRED EMBODIMENT

Figure 1D:
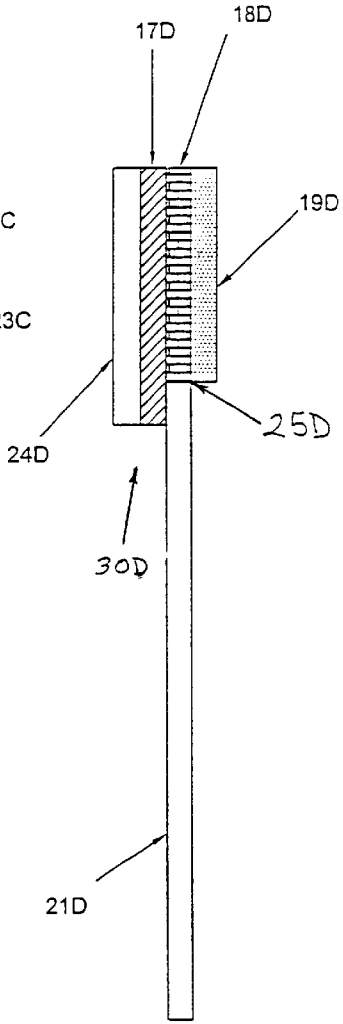
FIG. 1D is a not-to-scale side view of another alternative construction of the form of FIG. 1A, with the thicknesses of the components greatly exaggerated.

Throughout this written description, like-numbered components in the description correspond to like-numbered components in the drawings.

Figure 1C:
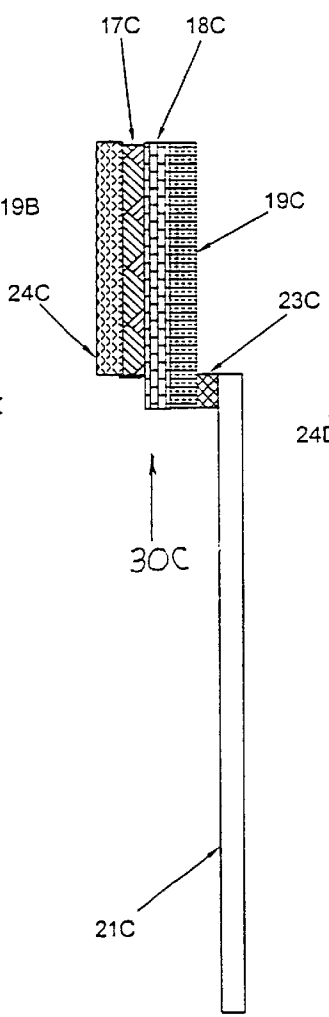
FIG. 1C is a not-to-scale side view of another alternative construction of the form of FIG. 1A, with the thicknesses of the components greatly exaggerated.
Figure 1B:
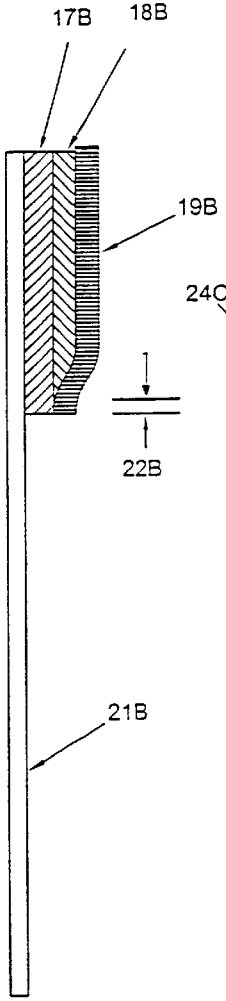
FIG. 1B is a not-to-scale side view of one alternative construction of the form of FIG. 1A, with the thicknesses of the components greatly exaggerated.
Figure 1A:
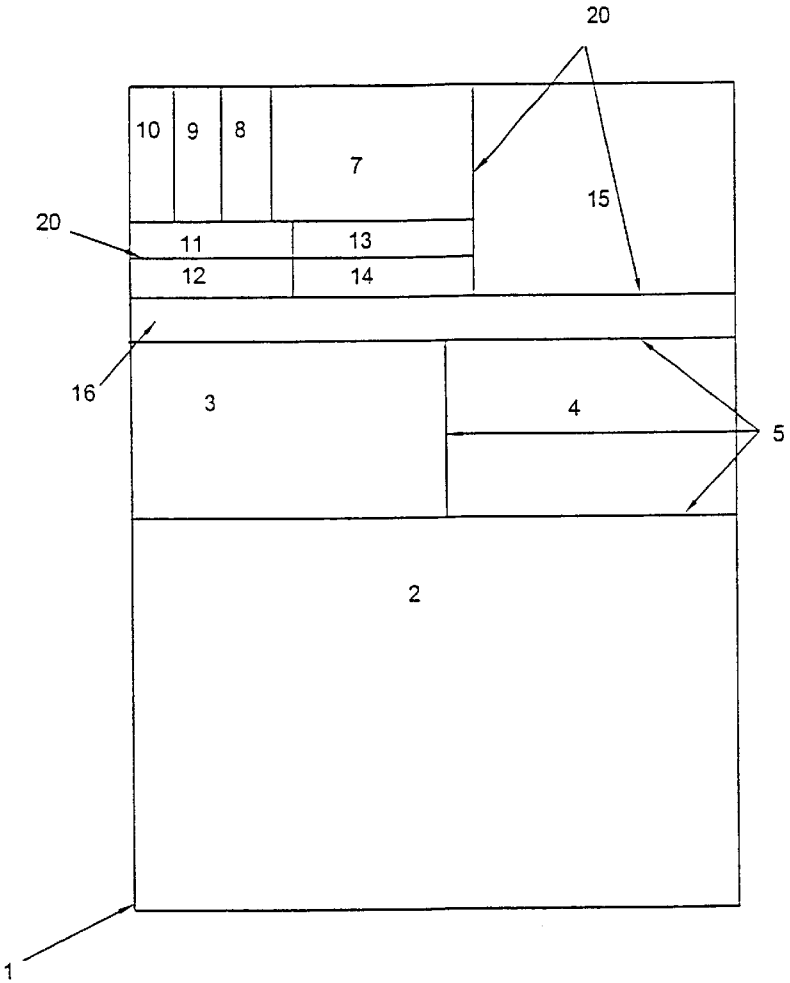
FIG. 1A is a drawing of the front face of an illustrative example of existing-art pharmacy forms.

Some information regarding existing pharmacy forms and methods of producing same will facilitate understanding of the present invention and its advantages over the prior art. FIG. 1A shows the front face of a typical existing art pharmacy form 1, and depicts a typical arrangement of label and non-label portions. Form 1 has a large area 2 upon which can be printed patient advisory or other information to be provided to a patient with the prescribed medication. Areas 3 and 4, which can be used for receipts or other purposes, are separated from area 2 and from the other portions of the form by perforation lines 5. Areas 7 through 15 are comprised of adhesive-backed label material, and are generally separated by die cuts 20 extending through the label to, but not through, an underlying liner. Typically, area 7 might be used as a label for a prescription container, generally suitable for printing with the patient's name, the name of the medication, the prescribing doctor, dosage instructions, and other information commonly provided with a prescription. Areas 8 through 14 can be used for warning labels such as "may cause drowsiness" or the like. Area 15 can be used for inventory information, for imprinting with patient-or prescription-specific information to paste into a log, or for other purposes the pharmacy may desire. Persons skilled in the art will appreciate that the number, size and arrangement of the label and non-label portions can vary widely.

There are 3 basic layered constructions commonly used to create a pharmacy form with a general layout such as is shown in FIG. 1A. Each of these alternative constructions is illustrated, in edge view, in FIGS. 1B–1D. The caliper of the components is greatly exaggerated for purposes of explanation and clarity, and the edge views of FIGS. 1B–1D are not to scale. Moreover, and to avoid unnecessary detail, FIGS. 1B–1D do not show die cuts or perforations in the form. FIG. 1B shows a side view of an existing art label 1 constructed by using hot melt adhesive 17B to join a liner with a standard sized paper stock 21B. A release liner 19B, which has been previously coated with silicone or other release agent 18B and pressure sensitive hot-melt adhesive 17B, is applied to the reverse face of the portion of paper stock 21B that will form the adhesive label portions 7–15 of the finished form. Hot melt adhesive 17B is typically applied directly to the release agent 18B of liner 19B, and then placed in contact with the reverse side of paper stock 21B. The adhesive then transfers to the reverse face of paper stock 21B; because the adhesive does not permanently adhere to the release agent 18B, however, areas 7–15 of form 1 can be readily removed from liner 19B and then adhered to another surface (such as a medication vial or. other container). Generally, release liner 19B has a small portion 22B on which there is no silicone or other release coating. When adhesive 17B is applied over the entire length of liner 19B, and said liner is placed in contact with paper stock 21B, the adhesive transfers to the reverse side of paper stock 21B. Die-cut portions 7 through 15, because they are situate over portions of release liner 19B containing silicone release agent 18B, can be readily removed from the form. However, the area 22B of liner 19B without release agent 18B becomes permanently adhered to sheet 21B, thereby forming seam 16 (as shown in FIG. 1A). Although seam area 16 in this particular construction is printable by a printing press or a laser printer, there are numerous drawbacks to this construction. Because emulsion acrylic adhesives typically require a significant drying capacity on a label production line, adhesive 17B is usually a hot-melt adhesive. However, hot-melt adhesives can be troublesome to deal with in a production facility. Moreover, hot-melt adhesives are oil based. Overtime, this oil can migrate through the face stock of a label and be unsightly. Moreover, the use of hot-melt adhesives does not solve, and can aggravate, problems associated with duplex printing.

FIG. 1C shows an alternative construction for a pharmacy form such as form 1. In this alternative, a preconstructed pressure sensitive label product 30C is mated to a bond paper face stock 21C using a seam adhesive 23C. Preconstructed label stock 30C is composed of a liner 19C treated with silicone or other release agent 18C. Adhesive 17C (which could be hot-melt or emulsion acrylic) then releasably adheres label stock 24C to the release agent coated face of liner 19C. Water-based seam adhesive 23C is applied to form a very thin bead to join label stock 30C with bond paper 21C to form a continuous web of label material and bond paper. The colors and graphics required by the customer are printed on the front and the back of the form, the label areas are die cut to the customer specifications, and the form is sheeted into a sheet of the proper size for the laser printer. This construction allows a label manufacturer to avoid the production problems associated with hot-melt and emulsion acrylic adhesives discussed with regard to FIG. 1B. Because seam adhesive 23C is applied in a thin bead, extensive drying capacity is not needed. If label stock 30C is obtained by a form manufacturer from an outside vendor, the manufacturer can avoid the production difficulties attendant to applying adhesive 17C during production of label stock 30C. Although solving some problems, however, the construction of FIG. 1C creates other problems. In this construction, resulting seam area 16 (FIG. 1A) is typically an exposed portion of silicone-coated release liner 19C. The silicone (or other release agent) is generally not printable, resulting in unusable space on the form. This construction also requires a form manufacturer to stock multiple sizes of label stock 30C so as to accommodate varying needs of different pharmacies. This construction also results in a thicker and bulkier form. Like the construction of FIG. 1B, this construction also fails to address problems associated with duplex printing.

FIG. 1D shows a third alternative construction for a pharmacy form such as form 1. As in FIG. 1C, the construction of FIG. 1D employs a preconstructed label stock 30D comprising label stock 24D, adhesive (hot-melt or emulsion acrylic) 17D, release coating 18D, and liner 19D. This construction removes a portion of liner 19D and the release coating 18D to expose a strip of adhesive 17D. This adhesive is then bonded to the paper stock 21D. Like the construction of FIG. 1C, this construction also requires a form manufacturer to inventory multiple sizes of label stock 30D to accommodate different pharmacies. Another disadvantage of this construction is that any slight variations in the alignment between label stock 30D and the paper stock 21 D while they are being mated together can leave exposed adhesive in the area of 25D that can collect dirt and other debris that can contaminate the printer. This area is typically much greater than any area inside die cuts 20 and the potential for printer contamination is also much greater. This construction also fails to address problems associated with duplex printing.

As mentioned above, different pharmacies may have varying requirements for the size and configuration of the label and non-label portions of a form. Using some existing methods, it is therefore often necessary for a form manufacturer to stock multiple sizes of pressure sensitive label stock to be joined to bond paper to manufacture a standard sized pharmacy form. Similarly, existing pharmacy forms are typically manufactured using a hot-melt or emulsion acrylic adhesive. Such adhesives are generally more susceptible to extruding from a form when opposing faces of a form are heated by a laser printer's fuser unit and the sheets are then pinched, such as may occur between the rollers of a laser printer. Moreover, hot-melt and emulsion acrylic adhesives become more fluid when reheated, such as may occur during multiple passes through a laser printer. This increased fluidity can increase the risk of the adhesive contaminating the printer. Existing manufacturing methods also limit, as a practical matter, the precision with which hot-melt adhesive can be applied to a form during manufacture thereof. Typically a hot-melt adhesive is applied to a liner web by slot coating, wherein the adhesive is extruded out of a slot as wide as the liner web. Although it is possible to extrude the adhesive in a width slightly narrower than the width of the liner web, any tracking error of the liner web through the press can cause the area intended to be void of adhesive to increase or decrease. Moreover, slot coating does not readily permit limitation of adhesive coating in a direction perpendicular to the path of the liner web's travel through the press.

Figure 2:
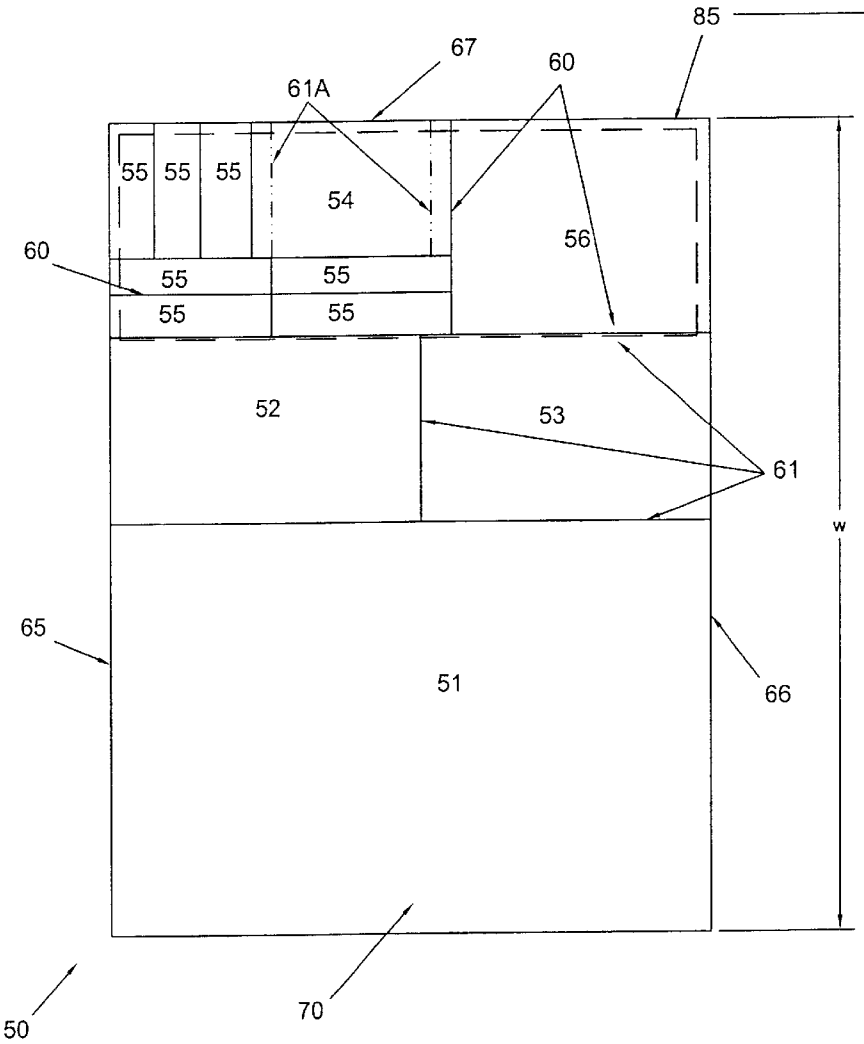
FIG. 2 is a front view of a form of the present invention.

The advantageous form of the present invention is depicted in FIGS. 2 (front face view) and 3 (side view). As shown in FIG. 2, the labels, patient advisory handout and other components of improved pharmacy form 50 can be arranged in the same general layout as is found in existing art forms such as form 1. Persons skilled in the art will appreciate, however, that the size, quantity, arrangement and end uses of these components can be varied without departing from the scope of the invention. Area 51 provides a large bond paper area upon which can be printed patient advisory information or other information to be provided to a patient with a prescription medication. Areas 52 and 53, which are detachable from other portions of form 50 along perforation lines 61, provide bond paper segments useful as receipts, etc. Areas 54 through 56 are adhesive backed and removable, along die cuts 60, and useful as labels. Area 54 forms a pharmacy vial label upon which can be printed the usual information (e.g., doctor's name, patient's name, medication, dosage, etc.). Areas 55 can be used to create warning labels (e.g., "may cause drowsiness," etc.). Area 56 is an additional label area that can be used for any purpose a pharmacy may choose (e.g., inventory labels, patient signature labels, etc.). Alternatively, areas 52 and 53 can also be label sections similar to areas 54–56.

Figure 3:
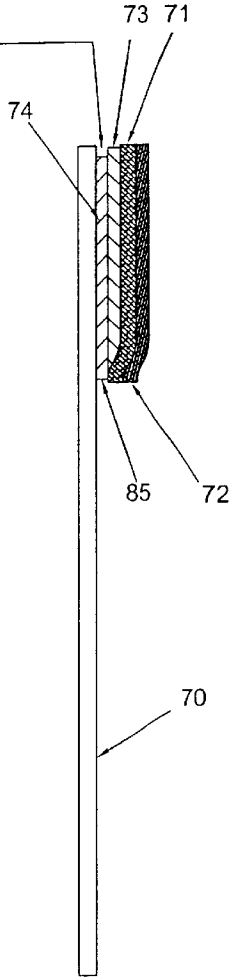
FIG. 3 is a not-to-scale side view of the form of FIG. 2, with the thicknesses of the components greatly exaggerated.

FIG. 3 shows a side view of form 50; FIG. 3 is not to scale, and the caliper of the components has been greatly exaggerated for clarity. To avoid unnecessary detail, FIG. 3 does not show perforation lines 61, perforation relief lines 61A or die cuts 60. Persons skilled in the art will appreciate, however, that perforation lines 61 comprise lines of intermittent perforations through bond paper 70 (and liner 72), and that die cuts 60 comprise cuts through bond paper 70 into adhesive 74, but not through liner 72. As set forth below, perforation relief lines 61A may extend through bond paper 70 and liner 72. Preferably, however, the perforations of perforation relief lines 61A only extend through bond paper 70 into adhesive 74, but not through liner 72. Form 50 is formed in a single pass through a rotary flexographic printing press. A continuous width w (representing the width of a roll of bond paper feeding a production line) of bond paper 70 is used, with that width based on (and often corresponding to) the customer's requirements for the finished form length. The reverse side of bond paper 70 has a release liner 72 affixed to it. The liner has been coated with a release agent 73 and an adhesive 74. Additionally, release liner 72 may have printing 71 on its contact face. Printing 71, release agent 73, and adhesive 74 on the contact face of liner 72 are applied during manufacture of form 50 and cured to a stable state using ultraviolet radiation (UV), as described below. The contact face of liner 72 can be printed with a coupon, important telephone numbers, or other information using inks cured with UV prior to applying the silicone release agent 73.

As shown in FIG. 2, perforation relief lines 61A are preferably placed in the portion of bond paper 70 that will later form vial label 54. Perforation relief lines 61A serve to relieve stress on the edges of vial label 54 when it is later affixed to a round pharmacy vial. More specifically, the preferred bond paper 70 (as described below in more detail) tends to have a strong "memory" and can resist bending around a small radius (such as a pharmacy vial). The problem increases with vials of smaller radii, and conversely, decreases with larger radii. The preferred adhesive 74 (described below) has excellent repositionability, and allows a pharmacist (or other person) to remove a label from (and reposition a label on) a plastic vial or other non-porous surface if initially placed incorrectly. The label is only repositionable for a short time, as preferred adhesive 74 begins to form a permanent bond after a few minutes. During that time, however, the memory of preferred bond paper 70 tends to pull the longitudinal edges of vial label 54 (i.e., the edges of the label substantially perpendicular to the label edges that that follow the vial's cylindrical circumference) away from a vial. Without perforation relief lines 61A, which are oriented substantially parallel to a vial's longitudinal axis when a label is placed on the vial, the longitudinal edges of a vial label may rise from the vial by approximately 1 to 2 mm. Although the label may not come off completely, the raised edges are unsightly and a nuisance. Perforation relief lines 61A sufficiently relieve the stress in a vial label caused by bond paper memory and allow the adhesive to resist label edge lifting while the adhesive permanently sets. Preferably, perforation relief lines 61A are 8 teeth per inch (tpi) with a 0.032 inch "tie" or uncut area between perforations. Perforations of this size are barely noticeable to a customer and do not impact laser printing quality. Perforation lines 61 need not necessarily be of the same size as perforation relief lines 61A. Perforation relief lines 61A are preferably located between 0.125 inch and 0.375 inch from the longitudinal edges of a vial label. Perforation relief lines 61A may extend through both bond paper 70 and liner 72. Preferably, however, and to facilitate easier label removal from liner 72, the perforations of perforation relief lines 61A do not extend through liner 72. Additional perforation relief lines may optionally be included on other label portions intended for vial placement, but are not as critical for warning labels or other smaller labels.

Figure 4:
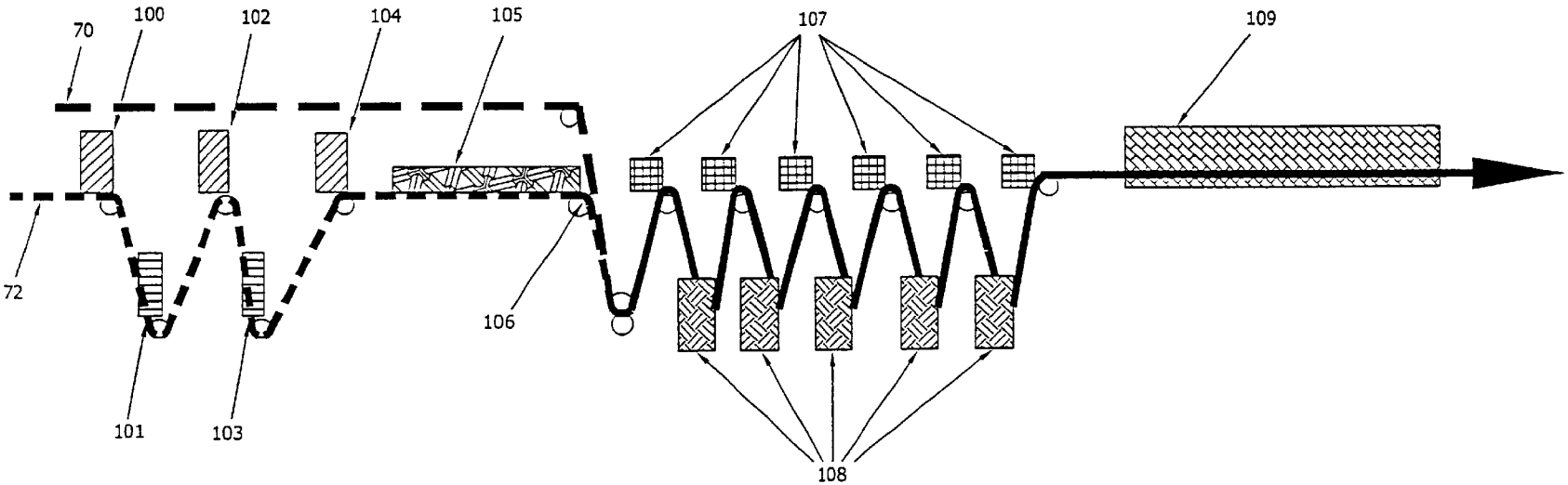
FIG. 4 is a schematic diagram of a method of producing the form of FIG. 2 according to present invention.

FIG. 4 shows the process of manufacturing form 50. Liner paper 72 is shown entering the production line, as a continuous web, at the left hand side. Specifically, sheeted edge 66 of one form's liner 72 is joined to sheeted edge 65 of another form's liner 72, etc. The continuous web of liner material 72 travels through the press along a direction parallel to web edge 67. Preferably, liner paper 72 is 30# or 40# basis weight with properties in the ranges set forth in Table 1.

TABLE 1

| | | |
|---|---|---|
| Basis Weight (lb./3000 ft$^2$) | 30 | 40 |
| caliper (mils) | 1.9 | 2.6 |
| Hagerty porosity (sec/250 cc) | 50,000 | 10,000 |
| Sheffield smoothness FS (Parker S-10) | 4.3 | 4.2 |
| Tear (machine direction) (gms/sheet Elmendorf) | 25 | 37 |
| (cross direction) (gms/sheet Elmendorf) | 28 | 38 |

Printing 71, release agent 73 and adhesive 74 are applied to the wire side of liner paper 72. The other face of liner paper 72 has a machine finish to ensure toner anchorage when variable data is printed by a laser printer. Preferably, liner 72 can be a product available from Wassau Mosinee Paper Corp. called "40 LB. UV400 MF RELEASE" or "30 LB. UV-350 MF RELEASE." However, other liner products from other manufacturers, as well as products with some or all properties outside of the ranges set forth in Table 1, will also function.

Liner paper 72 is fed from a roll using equipment well known in the art. Although liner 72 is shown as a single sheet of paper in the finished form 50 of FIGS. 2 and 3, those skilled in the art will recognize that individual forms 50 are produced from continuous rolls of liner 72 and bond paper 70 which can be cut to form individual forms such as shown in FIG. 2. Persons skilled in the art will further recognize that finished individual forms 50 need not be completely separated, and that multiple forms 50 could remain joined by perforation lines along sheeted edges 65, 66 separating individual forms from one another so as to, inter alia, allow printing in a continuous form printer.

At station 100, the wire side of liner paper web 72 is printed with UV-curable background ink 71 (although both faces of liner web 72 could be printed prior to application of release agent 73 and adhesive 74, printing of the reverse face of liner 72 would typically occur after mating to bond paper 70 so as to allow alignment of any graphics or other matter spanning the reverse faces of both liner 72 and bond paper 70). Although the invention is not limited by what is printed upon the background of liner 72, liner 72 might typically be printed with coupons for the pharmacy, advertisements, additional advisory information, or any other material the pharmacy may wish to include. Background ink print station 100 can employ any of numerous methods well known in the art, such as rotary flexographic or rotary offset, and using known and commercially-available equipment.

After printing at station 100, the background ink is cured at UV cure unit 101. Cure of the ink at cure unit 101 can be accomplished with a single 400 watt UV lamp system, such as is currently available from Fusion UV Systems, Inc. under the trademark ULTRAPAK. However, conversion to a single 600 watt microwave activated lamp system with an H bulb (such as is also available from Fusion UV Systems, Inc.) will allow more consistent production, as this system does not suffer from the effects of filament degradation in the lamp. Increased wattage may also allow some increase in cure rates and press speed. Press speeds are targeted to be 400+feet per minute using a single 400 watt lamp. If necessary, liner 72 may pass through multiple stations of imprinting and curing of background ink to increase cure speed and press speed.

After background ink 71 is cured at station 101, background-printed liner 72 passes through silicone release agent application station 102. At station 102, an UV-curable silicone release agent 73 is applied to liner 72. This release agent can be any of many of types well known in the art. Preferably, release agent, 73 is a one-part, 100 % silicone release coating that is curable with a cationic curing system without nitrogen inerting, such as is available from Northwest Coatings Corp. under product number 15515, with the properties set forth in Table 2.

TABLE 2

| | |
|---|---|
| viscosity | 750–850 cps @ 77° F. (25° C.) |
| density | 8.3 ± 2 lbs/gal |
| cure rate | 200 ft/min per 300 W/inch lamp |

Although the above-described release agent is preferable, other UV-curable release agents available from other sources, with properties outside the ranges set forth in Table 2, could also be used. Station 102 can employ various methods and equipment, well known in the art, for application of a liquid agent to a paper liner. Preferably, however, release agent 73 is applied by a flexographic plate to allow for pattern coating. Pattern coating allows for specific placement of the release agent on the liner web to allow certain areas of the form to be removable while allowing other areas to remain attached to the liner. This feature becomes important when certain areas of the form are not used by the customer and are considered to be waste or the customer wants to insure that these portions remain with the form for future reference. Securing these portions securely to the liner also prevents them from coming free within the laser printer and causing printer malfunctions. Preferably, silicone release agent 73 application is to be 1 mil thick with a coat weight of 1 pound per 3000 sq. ft. ream. As shown in FIG. 3, the lower ¼" of the liner 72 is left free of silicone release agent 73 so that when adhesive 74 is applied to the entire width of liner 72, the adhesive provides a paper-to-paper bond between liner 72 and the reverse side of face stock 70. This forms a very strong bond and insures the form's stability during the making of die cuts 60. This method of creating a seam between the liner 72 and the face stock 70 also forms a seam with very low overall caliper while providing a very sooth and flat surface upon which both the flexographic press and a laser printer may image.

After application of silicone release agent 73 at station 102, liner 72 passes to curing station 103. At station 103, the previously-applied silicone release agent 73 is cured to a stable state using ultraviolet radiation. Cure of release agent 73 can also be accomplished with a single 400 watt UV lamp system, such as is currently available from Fusion UV Systems, Inc. under the trademark ULTRAPAK. However, conversion to a single 600 watt microwave activated lamp system with an H bulb (such as is also available from Fusion UV Systems, Inc.) will allow more consistent production, as this system does not suffer from the effects of filament degradation in the lamp. Increased wattage may also allow some increase in cure rates and press speed.

After release agent 73 has been cured on liner 72 at station 103, liner 72 (with cured release agent 73) passes to adhesive application station 104. At station 104, UV-curable adhesive 74 is applied onto the surface of cured release agent 73. Preferably, adhesive 74 is a medium viscosity, high peel strength UV-curable pressure sensitive adhesive, such as is available from Reichhold, Inc. under the name RAD-LOCK UV 2520, with typical properties as set forth in Table 3.

TABLE 3

| | |
|---|---|
| viscosity | 2500 cps (25° C.) |
| cured loop tack (STM 209) | 4.5 lbs/in$^2$ |
| cured 180 peel (PSTC-1 (STM 145)) | 4.3 lbs/in |
| solids | 100% |
| Volatile Organic Compounds | 0% |

The preferred adhesive has also proven advantageous for pharmacy applications, as it allows a label to be repositioned on a medicine container. More specifically, labels having the preferred adhesive, once removed from the form's liner, can be placed on a plastic medicine vial, and for a short period of time, removed and repositioned. Although the above described adhesive is preferable, however, other adhesives (including those with properties outside the range set forth in Table 3) would also be satisfactory. Examples include Northwest Coatings Corp. UV adhesive 16750 and Craig Adhesives and Coatings Co. CRAIGCURE 1029E. Station 104 can employ various methods and equipment, well-known in the art, for application of a liquid material to a moving substrate preferably however, adhesive 74 is applied at station 104 by rotary flexographic press using a flexographic plate allowing the adhesive to be pattern coated in specific areas so as to minimize the ability of the adhesive to migrate into the laser printer during printing of variable data. Preferably, adhesive 74 is applied in a single pass by an anilox roller system and a flexographic printing plate with a coat weight of 14 lbs per each 3000 sq ft. ream.

At this point, it should be noted that the use of UV-curable adhesive 74 in the manufacture of improved pharmacy form 50 provides an important advantage over existing forms. In particular, adhesive 74 can be applied in a much more precise and limited manner than would be possible using conventional methods and adhesives. Application of the adhesive using a flexographic plate, instead of by a flood roller or an extrusion head (as is most often used), allows for precise register of the adhesive within particular areas. Typical hot melt adhesives are applied using a slot extrusion coating method which does not allow offsetting of the adhesive along the sheeted edge of the form. The application of adhesive using a flexographic plate allows very precise adhesive application in very specific areas. By altering the properties of the adhesive plate, it is also possible to vary the coat weight of the adhesive in specific areas to control the adhesion properties of the label.

Figure 5:
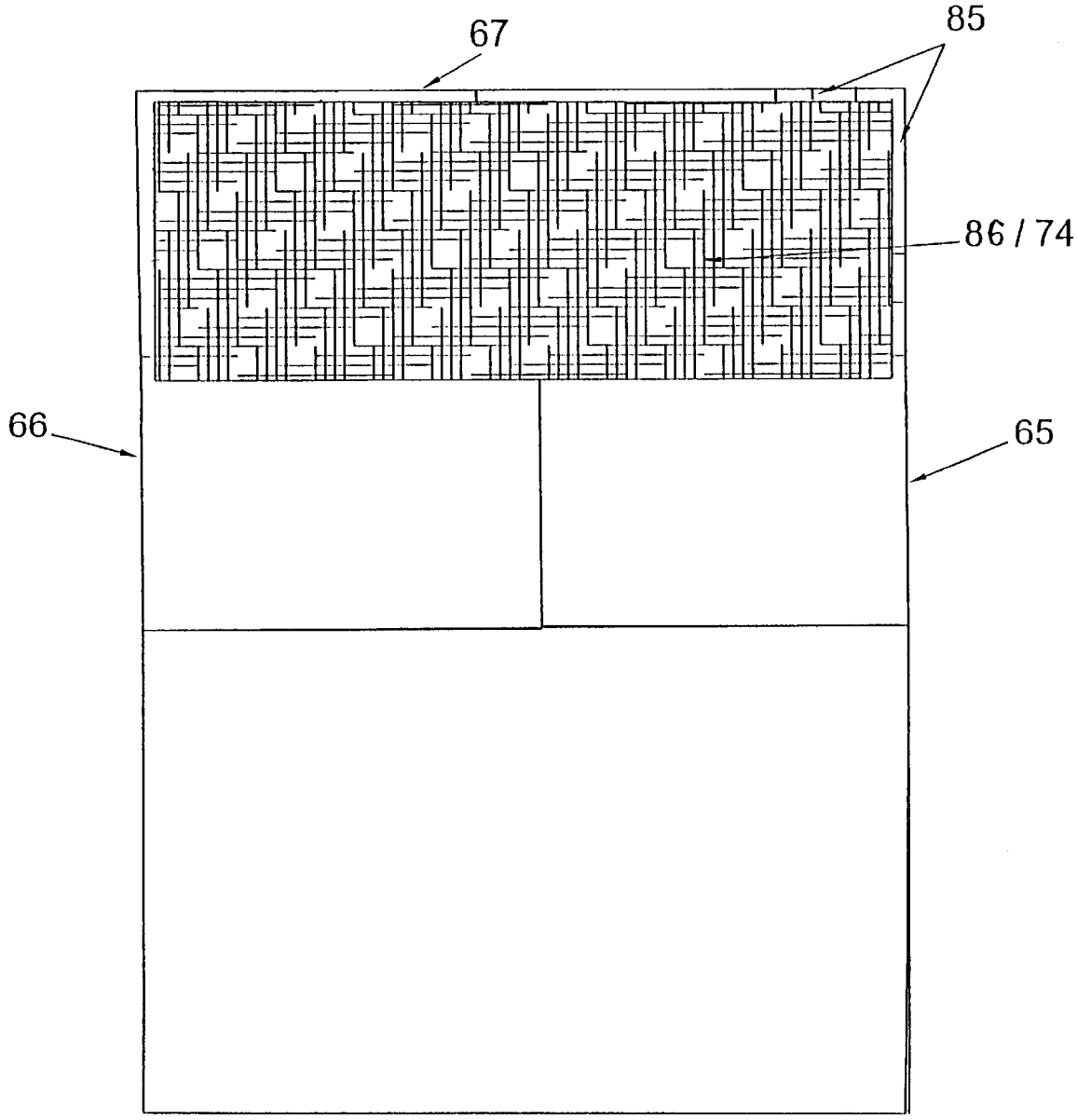
FIG. 5 is a drawing showing the area of patterned adhesive and the area with no adhesive.

This added precision in adhesive application al lows, for example, the area of applied adhesive to be offset from the edge of form 50. As shown in FIGS. 2, 3 and 5, adhesive 74 is offset from the edges of the label portions of the form. In particular, and as is shown with regard to label portions 54–56 with a hidden line, adhesive 74 does not extend to the edge of form 50. For clarity and to avoid unnecessary complication of the drawings, adhesive 74 is not offset from all edges of areas 54–56, but adhesive 74 is offset around the perimeter of the label portions of the form. This offset of the adhesive helps prevent printer contamination when form 50 is passed through a laser printer. Specifically, as form 50 passes through a printer's rollers, any adhesive that is squeezed by the rollers' pressure on the faces of the form does not extrude to the edge of the form, and thus does not escape to damage the printer's components. FIG. 5 shows the reverse face of bond paper 70 of form 50 from FIG. 2, with liner 72 (together with ink 71 and release agent 73) removed for clarity. The area 85 is the area where no adhesive has been applied, while area 86 represents the area where adhesive 74 has been applied. As shown in FIG. 5, the present invention allows adhesive offset along the sheeted edges 65, 66 and web edges 67 of form 50. Moreover, improved qualities of UV-curable adhesives in comparison to conventional hot-melt and emulsion acrylic adhesives help prevent printer contamination, as UV-curable adhesives do not become as fluid as conventional hot-melt or emulsion acrylic adhesives when heated by a laser printer.

Figure 6:
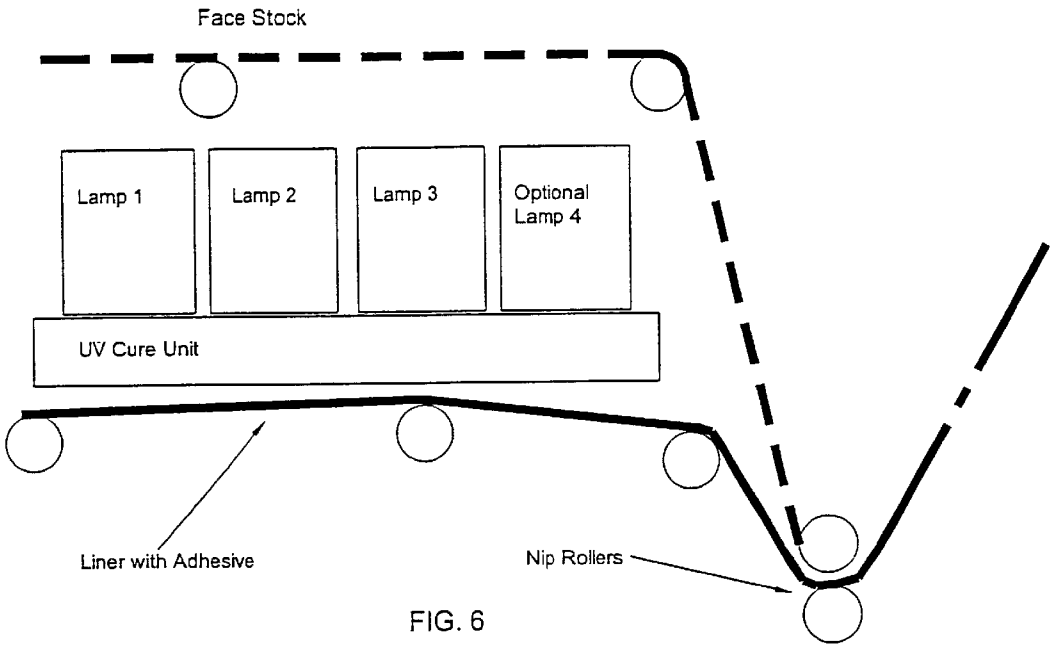
FIG. 6 is a drawing of an ultraviolet cure unit for curing adhesive.
Figure 7:
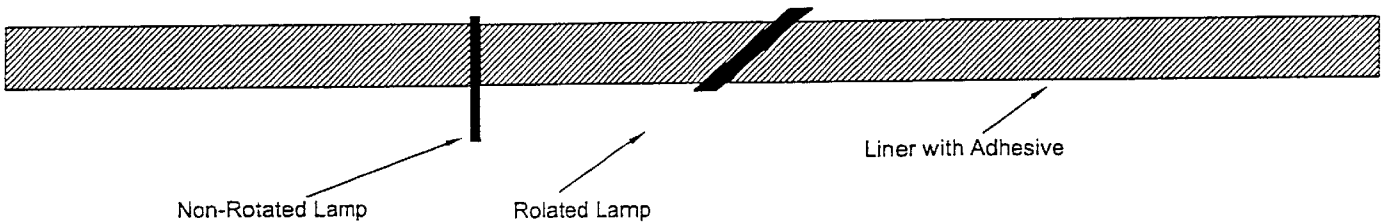
FIG. 7 is a drawing of lamp orientation within the cure unit of FIG. 6.

After application of adhesive 74 at station 104, liner web 72 passes to cure station 105, where adhesive 74 is cured, with UV, to a stable state. Cure station 105 is shown schematically in FIG. 4, and in more detail in FIGS. 6 and 7. Adhesive 74 is applied to the cured silicone release agent 73 previously applied to the wire side of liner web 72. The uncured adhesive passes into a UV cure system to cure the adhesive before mating it to the bond paper face stock 70. Preferably, cure station 105 comprises 3 or more individual microwave activated lamp assemblies, such as a Model F600S-30 Ultraviolet Curing System available from Fusion UV Systems, Inc. These lamps are "H" lamps, the letter designation referring to the spectrum of light that is produced. Different UV-curable products use different photo-initiators in their formulation to start the cure process; an H bulb provides the best cure for the preferred adhesive. The microwave activated lamps are 10" long, but liner web 72 is significantly less wide. Accordingly, the cure lamps are rotated, as shown in FIG. 7, so as to use more lamp output than would be used if the lamps were not rotated. Each lamp is mounted in a housing that is mounted to a circular base that will allow it to be rotated. For a 3½" liner web, the lamps are rotated to approximately 26°. The rotated lamp gives the effect of a much larger lamp because the adhesive is exposed to the full light energy for a longer period of time. The ability to rotate the lamps also allows production of different widths of liner and adhesive for different customers by changing the angle of rotation. Matching the rotation angle to the liner width maximizes the lamp power. If the lamp were perpendicular to the web, ⅔ of the lamp energy would be wasted because there would be no liner or adhesive below it. The cure unit also provides exhaust.ventilation (not shown) for the ozone produced and air circulation needed to cool the lamps and housing (not shown). Each lamp is a 600 watt "H" bulb. This configuration of lamp power and the orientation of the lamps within their housings will provide enough cure power to run the press in excess of 500 fpm and accomplish the required cure in one pass through the cure system.

After the above-described processing of liner 72, liner 72 (with cured silicone release agent 73 and adhesive 74) is mated to face stock 70 at station 106. Preferably, face stock 70 is 24# MOCR laser printable paper, such as is available from Champion, Boise-Cascade, or Georgia Pacific, with properties as set forth in Table 4.

TABLE 4

| | |
|---|---|
| Basis Weight (lb./3000 $ft^2$) | 24 |
| caliper (mils) | 4.6 |
| moisture % | 4.7–5.0 |

Face stock 70 should also have sufficient smoothness and opacity for use as a label and for laser printing. Papers such as the preferred face stock have shown to be moisture stable under the heat and pressures of duplex printing through a laser printer. Liner 72 and face stock 70 are mated using conventional means well known in the art, such as an adjustable nip roller (FIG. 6) to apply a positive pressure between the face sheet 70 and the liner 72, release agent 73, and the adhesive 74. The pressure of the nip roller insures that the adhesive 74 is firmly transferred to the face stock 70.

This invention avoids a seam on the front of the form because the silicone release agent 73 is pattern coated to leave a void area at the lower edge of the liner 72. The adhesive 74 is pattern coated to cover all of this void area except for the lower 1/32" to prevent the possibility of printer contamination by the adhesive in this area. The adhesive 74 provides a positive face 70 to liner 72 bond in this narrow area insuring the form will remain in one piece as the labels are die cut in the adhesive portion of the form. The area of the face opposite the seam is printable by the printing press or by the laser printer because this area is made up of the continuous bond paper 70 used to make the face of the form. The reverse face of liner 72 is also printable over the entire surface because it is a machine finished liner which provides the surface necessary for printing by either a printing press or laser printer.

After station 106, mated liner 72 and face stock 70 pass through one or more series of ink application stations 107 and dryer stations 108. The type of printing process and ink used is not an element of the invention, but can include flexographic, offset or other methods. Both front and reverse faces of mated liner 72 and face stock 70 can be printed. After printing is complete, mated and printed liner 72 and face stock 70 pass through one or more stations 109 for die cutting, waste removal, perforation, cutting into individual forms, stacking and/or folding, packaging and other steps well known in the art.

The foregoing description is of a preferred embodiment of a form with label and non-label portions, and a method for manufacturing same, and is intended to instruct those skilled in the art how to make and use the invention. Such persons will appreciate, however, that there are many possible variations and modifications to the above-described embodiment of the invention. Throughout this written description, the invention has been described in the context of a form adapted for pharmacy use. Persons skilled in the art will recognize, however, that the invention is not limited to pharmacy uses, and includes other applications where a form with label and non-label portions is needed. Examples can include (but are not limited to) shipping documents, inventory records, or any other application where it would be useful to custom print individual forms having label and non-label portions.

Although the preferred embodiment describes a form intended for pharmacy use, the invention is not limited by the preferred embodiment, but instead includes all modifications, variations and equivalents, and is limited only by the attached claims, which claims are to be given the widest scope consistent with the principles disclosed and as may be allowed by the prior art.

We claim:

1. A printable form with label and non-label portions, comprising:

a paper liner sheet having first and second faces, wherein at least a portion of said first face has been coated with a release agent cured to a stable state using ultraviolet radiation, and at least a portion of said first face has been further coated with a pressure-sensitive adhesive, said adhesive having been cured to a stable state using ultraviolet radiation; and a paper face sheet, wherein at least a portion of said face sheet is in contact with said adhesive, and at least a portion of said face sheet in contact with said adhesive is a label portion removable from said liner sheet and capable of being adhesively applied to another surface, wherein said face sheet comprises paper with a basis weight of at least 24 lbs per 3000 $ft^2$, said first face is the wire side of said paper liner and said second face has a machine finish, and wherein said release agent and said adhesive have been applied to said first face, said release agent comprises silicone, said paper liner sheet comprises paper with a basis weight in the approximate range of 30 lbs per 3000 $ft^2$ to 40 lbs per 3000 $ft^2$, and wherein a portion of said first face has not been coated with said release agent.

2. The form of claim 1, wherein said first face contains one or more adhesive voids, said voids comprising areas of said first face not coated with said adhesive.

3. The form of claim 2, wherein said label portion has, upon removal from said liner sheet, an adhesive face and an outer face, and wherein said adhesive face comprises an adhesive void along at least a first peripheral edge of said adhesive face.

4. The form of claim 3, wherein said first peripheral edge is, prior to removal of said label portion from said liner sheet, substantially parallel to a sheeted edge of said form.

5. The form of claim 4, wherein said adhesive face has another adhesive void along a second peripheral edge of said adhesive face, and wherein said second peripheral edge is, prior to removal of said label portion from said liner sheet, substantially parallel to a web edge of said form.

6. The form of claim 5, wherein said first face has been preprinted prior to coating with said release agent.

7. A printable form with label and non-label portions, comprising:

a paper liner sheet having first and second faces, wherein at least a portion of said first face has been coated with a release agent cured to a stable state using ultraviolet radiation, and at least a portion of said first face has been further coated with a pressure-sensitive adhesive, said adhesive having been cured to a stable state using ultraviolet radiation; and a paper face sheet, wherein at least a portion of said face sheet is in contact with said adhesive, and at least a portion of said face sheet in contact with said adhesive is a label portion removable from said liner sheet and capable of being adhesively applied to another surface, wherein said first face is the wire side of said paper liner and said second face has a machine finish, and wherein said release agent and said adhesive have been applied to said first face, said release agent comprises silicone, and wherein a portion of said first face has not been coated with said release agent.

8. The form of claim 7, wherein said first face contains one or more adhesive voids, said voids comprising areas of said first face not coated with said adhesive.

9. The form of claim 8, wherein said label portion has, upon removal from said liner sheet, an adhesive face and an outer face, and wherein said adhesive face comprises an adhesive void along at least a first peripheral edge of said adhesive face.

10. The form of claim 9, wherein said first peripheral edge is, prior to removal of said label portion from said liner sheet, substantially parallel to a sheeted edge of said form.

11. The form of claim 10, wherein said adhesive face has another adhesive void along a second peripheral edge of said adhesive face, and wherein said second peripheral edge is, prior to removal of said label portion from said liner sheet, substantially parallel to a web edge of said form.

12. The form of claim 11, wherein said first face has been preprinted prior to coating with said release agent.

13. A printable form with label and non-label portions, comprising:

a paper liner sheet having first and second faces, wherein at least a portion of said first face has been coated with a release agent cured to a stable state using ultraviolet radiation, and at least a portion of said first face has been further coated with a pressure-sensitive adhesive, said adhesive having been cured to a stable state using ultraviolet radiation; and a paper face sheet, wherein at least a portion of said face sheet is in contact with said adhesive, and at least a portion of said face sheet in contact with said adhesive is a label portion removable from said liner sheet and capable of being adhesively applied to another surface, wherein said form is adapted for use by a pharmacy and contains at least one label portion adapted for use as a label for a medicine container and printed with information about a prescription drug, at least one label portion adapted for use as a warning label and printed with a warning message about said drug, and at least one non-label portion that contains information regarding said drug and is removable from said form.

14. The form of claim 13, wherein said face sheet comprises paper with a basis weight of at least 24 lbs per 3000 $ft^2$, said form has a front face and a reverse face, and said form has been printed on said front and reverse faces by a laser printer.

15. The form of claim 14, wherein said first face is the wire side of said paper liner and said second face has a machine finish, and wherein said release agent and said adhesive have been applied to said first face.

16. The form of claim 15, wherein said release agent comprises silicone.

17. The form of claim 16, wherein said paper liner sheet comprises paper with a basis weight in the approximate range of 30 lbs per 3000 $ft_2$ to 40 lbs per 3000 $ft^2$.

18. The form of claim 17, wherein a portion of said first face has not been coated with said release agent.

19. The form of claim 18, wherein said first face contains one or more adhesive voids, said voids comprising areas of said first face not coated with said adhesive.

20. The form of claim 19, wherein at least one of said label portions has, upon removal from said liner sheet, an adhesive face and an outer face, and wherein said adhesive face comprises an adhesive void along at least a first peripheral edge of said adhesive face.

21. The form of claim 20, wherein said first peripheral edge is, prior to removal of said label portion having said first peripheral edge from said liner sheet, substantially parallel to a sheeted edge of said form.

22. The form of claim 21, wherein said adhesive face has another adhesive void along a second peripheral edge of said adhesive face, and wherein said second peripheral edge is, prior to removal of said label portion having said second peripheral edge from said liner sheet, substantially parallel to a web edge of said form.

23. The form of claim 22, wherein said first face has been preprinted prior to coating with said release agent.

24. The form of claim 13, wherein said first face is the wire side of said paper liner and said second face has a machine finish, and wherein said release agent and said adhesive have been applied to said first face.

25. The form of claim 24, wherein said release agent comprises silicone.

26. The form of claim 25, wherein a portion of said first face has not been coated with said release agent.

27. The form of claim 26, wherein said first face contains one or more adhesive voids, said voids comprising areas of said first face not coated with said adhesive.

28. The form of claim 27, wherein at least one of said label portions has, upon removal from said liner sheet, an adhesive face and an outer face, and wherein said adhesive face comprises an adhesive void along at least a first peripheral edge of said adhesive face.

29. The form of claim 28, wherein said first peripheral edge is, prior to removal of said label portion having said first peripheral edge from said liner sheet, substantially parallel to a sheeted edge of said form.

30. The form of claim 29, wherein said adhesive face has another adhesive void along a second peripheral edge of said adhesive face, and wherein said second peripheral edge is, prior to removal of said label portion having said second peripheral edge from said liner sheet, substantially parallel to a web edge of said form.

31. The form of claim 30, wherein said first face has been preprinted prior to coating with said release agent.

32. The form of claim 25, wherein said adhesive allows at least one of said label portions, upon removal from said form, to be adhered to a non-porous surface, removed, and then re-adhered.

* * * * *